United States Patent [19]

Mansouris et al.

[11] Patent Number: 4,648,141

[45] Date of Patent: Mar. 10, 1987

[54] POWER OPERATED SEPARABLE BEDS AND PLATFORM

[76] Inventors: Mansour N. Mansouris, 1717 Sanysidro Dr., Beverly Hills, Calif. 90210; Masoud N. Mansouri, 427 Robinhood La., Los Angeles, Calif. 90049; Kambiz Imani, 11667 Ohio Ave., Los Angeles, Calif. 90025

[21] Appl. No.: 746,859

[22] Filed: Jun. 20, 1985

[51] Int. Cl.[4] ..... A47C 19/00

[52] U.S. Cl. ..... 5/8; 5/511; 248/430; 312/340

[58] Field of Search ..... 5/1, 8, 11, 18 R, 18 B, 5/510, 511; 248/393, 429, 430; 312/340, 341, 343, 344; 308/3.6, 3.8

[56] References Cited

U.S. PATENT DOCUMENTS

| | | | |
|---|---|---|---|
| 544,630 | 8/1895 | Scherer | 5/8 |
| 618,957 | 2/1899 | Kelly | 312/344 |
| 675,519 | 6/1901 | McDonnell | 5/148 |
| 866,954 | 9/1907 | Nehr | 5/8 |
| 965,577 | 7/1910 | Gemmer | 312/340 |
| 1,040,799 | 10/1912 | Skeffinglon | 74/199 |
| 1,079,870 | 11/1913 | Lloyd | 5/511 |
| 1,323,229 | 11/1919 | Borhauer | 5/8 |
| 1,350,327 | 8/1920 | Moir | 5/172 |
| 1,536,888 | 5/1925 | Kwiatkowski | 5/18 B |
| 1,920,855 | 8/1933 | Gloekler | 312/343 |
| 2,215,636 | 9/1980 | Comper | 5/69 |
| 2,235,904 | 3/1941 | Schulz | 248/430 |
| 2,350,228 | 5/1944 | Hanes | 312/340 |
| 2,383,173 | 8/1945 | Watter | 248/393 |
| 2,472,514 | 6/1949 | Brinkley | 5/511 |
| 2,644,168 | 7/1953 | Sandow | 5/18 B |
| 2,785,036 | 3/1957 | Elsden-King et al. | 312/327 |
| 3,015,532 | 1/1962 | Wilson | 312/344 |
| 3,384,431 | 5/1968 | Dargene | 312/341 |
| 4,438,994 | 3/1984 | Davis | 312/330 |
| 4,524,471 | 6/1985 | Mansouri et al. | 5/8 |
| 4,587,681 | 5/1986 | Mansouri et al. | 5/8 |

FOREIGN PATENT DOCUMENTS

| | | | |
|---|---|---|---|
| 2518647 | 9/1976 | Fed. Rep. of Germany | 312/341 |
| 682287 | 2/1965 | Italy | 5/8 |
| 41993 | 11/1937 | Netherlands | 5/8 |
| 6500097 | 7/1966 | Netherlands | 5/8 |
| 20137 | of 1909 | United Kingdom | 5/8 |
| 318798 | 9/1929 | United Kingdom | 248/430 |

*Primary Examiner*—John E. Murtagh
*Assistant Examiner*—Andrew Joseph Rudy
*Attorney, Agent, or Firm*—William H. Maxwell

[57] ABSTRACT

A composite bedding unit comprised of adjoining single bed units adapted to be juxtaposed in the form of double bedding and separable along a median line dividing the sleeping areas of two retiring individuals having distinct sleeping requirements when lying together, the two bed units being carried by a platform to which the bed units are mechanized to be separated from said median line for single bed conditioning, provision being made for safety and for ease of assembly and disassembly within a minimum of space.

14 Claims, 13 Drawing Figures

POWER OPERATED SEPARABLE BEDS AND PLATFORM

Reference is made to copending application Ser. No. 06/568,347 filed Jan. 5, 1984, entitled POWER OPERATED SEPARABLE BEDS AND SUPPORT THEREFOR, issued June 25, 1985, as U.S. Pat. No. 4,524,471, and copending division application thereof Ser. No. 06/733,884 filed May 14, 1985, now U.S. Pat. No. 4,587,681, entitled POWER OPERATED SEPARABLE BEDS AND SUPPORT THEREFOR.

BACKGROUND

Bedding is comprised generally of a mattress supported upon springs by a bedstead and over which sheets and blankets are drawn so as to cover one or more persons reclining thereon. Beds vary in size or capacity and are referred to as "single" or "double" beds, there being various sizes thereof. It is customary for two persons or individuals to retire upon one double bed, or so-called "Queen Size" or "King Size" bed, to share the same bed springs and mattress. It is also customary for two persons or individuals to retire upon separate single beds, so that one or the other is not disturbed when sleeping. Although humans are biologically the same with respect to functional requirements and body temperatures, there are differences of habit, likes and dislikes, brought about by sex, body weight, and idiosyncrasies. Accordingly, one person may be compatable with another person to a point, but disturbed by the sleeping habits of the other person, or simply unable to cope with the transfer of body heat and breathing, or there can be a great difference in the preference of cover weight and capture of heat.

It is a general object of this invention to provide for the selective positioning of separate beds by two individuals initially retiring together. In practice, each individual selects the time and closeness of bed adjacency or separation according to his or her choice, personal requirements and desires. In accordance with this invention, there are adjoining single beds carried by a common platform and separable from head to foot of the bed.

It is the comfort of two individuals retiring together side by side with which this invention is concerned. The continued presence and closeness to another person can be uncomfortable and disconcerting to otherwise compatable individuals, all because of their particular requirements. For example, one person may require a heavier blanket than another, causing the other person to perspire while the one person is comfortably warm, or permitting the one person to chill while the other is kept warm. Generally, a female will require heavier blanketing than a male, and corpulent persons require less blanketing; but all in degrees of preference. Also, a person may disturb another by movements such as thrashing about, or one person may be ill which presents the problem of health. Therefore, it is an object of this invention to provide for selective and variable separation by either person without disturing the other, the beds being mechanically separated from a median line by power means as will be described.

It is an object of this invention to provide an improved platform for separable bed units of the type under consideration that are adjacently related as hereinabve described. It is a bedding unit and platform that is provided, wherein a pair of single beds or the like are carried by a common platform which they coextensively overlie when brought together into adjacency and from which they contilever when they are separated.

It is an object of this invention to improve the means which prevents overturning when in the cantilevered condition, whereby the individual beds are stable even when a substantial portion thereof is projected laterally beyond the support of the said platform It is also an object of this invention to provide facility of assembly and disassembly within a minimum of room space, whereby this double-single bedding can be readily moved and installed, all as circumstances require.

It is an object of this invention to provide anti-friction stability at both the foot and head of a bedding unit of the type under consideration, wherein both the foot an headboard carry and guide the two separable single beds. In the preferred form of this invention there are front loading roller supports for the two bed units, characterized by installation accessibility through laterally open windows in transverse support rails. In the first form, the rollers operate within the rails with axle support through slots in the rails. In a second form, there are castor type roller supports enclosed within the protective confines of the rails. In a third form, the slotted rails capture a grooved roller, so as to prevent upward as well as downward displacement while confining the roller to rectilinear movement. In a fourth form the track opens upwardly for the roller. In each of these four embodiments there are windows for the simultaneous movement of the roller supports into and out of working position. In a fifth form, the roller supports ride on top of support rails and each bed unit is captured in working postion by retainer means.

SUMMARY OF THE INVENTION

A platform is supported upon the bedroom floor in the usual manner, with or without casters. In the head and foot of two like single spring and mattress units, there is a transverse track for rolling support, the single bed units being guided by both the head and foot portion of the platform. A feature of the track-support is the directional stability which it affords, and all of which is such as to facilitate assembly and disassembly while preventing collapse when in use. Conditioning of the single bed units is motorized for individual movements of either single bed unit by its occupant, or in unison if so desired. Motorization is disposed between the platform frame and each single bed unit, and the floor space and mechanism between is obscured by a protective floor panel when separation occurs. The two single bed units are conventional in every respect, and they are preferably identical so as to form a double bedding combination when brought into adjacency.

The foregoing and other various objects and features of this invention will be apparent and fully understood from the following detailed description of the typical preferred forms and applications thereof, throughout which description reference is made to the accompanying drawings.

Figure 3:
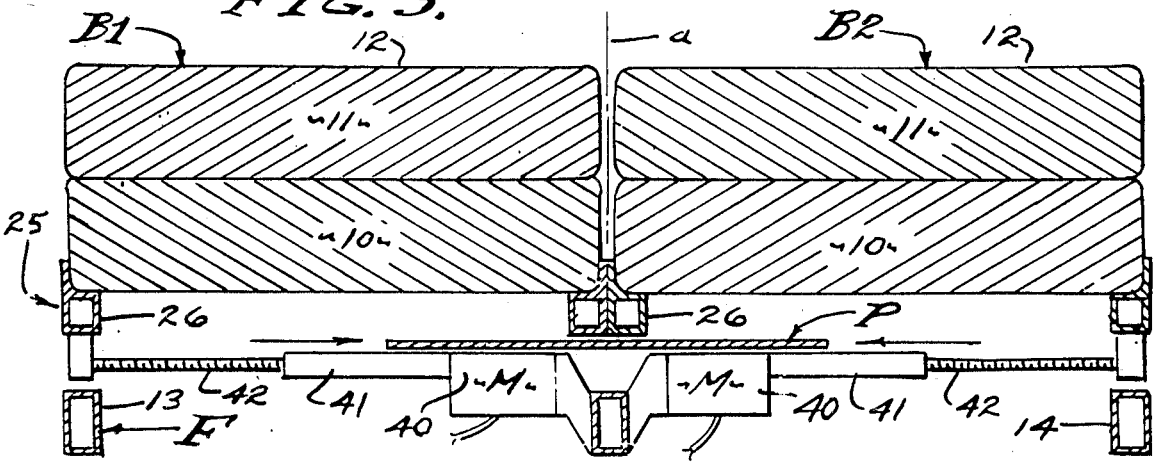
FIG. 3 is an enlarged transverse sectional view taken as indicated by line 3—3 on FIG. 1.
Figure 4:
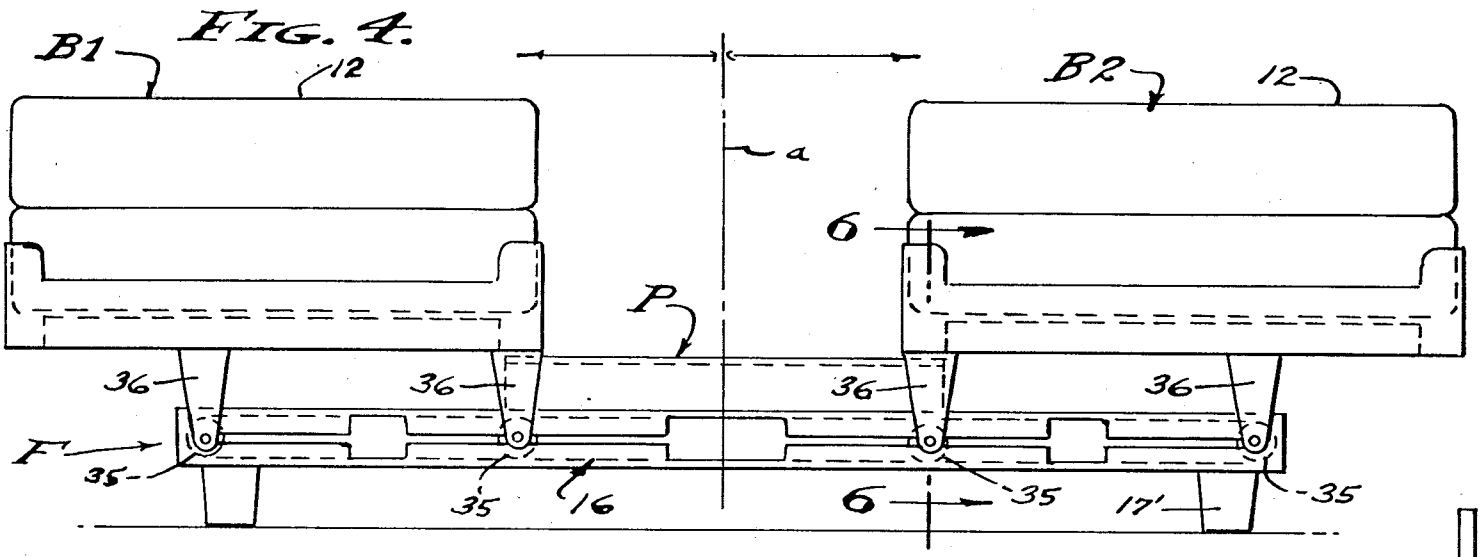
FIG. 4 is an enlarged transverse foot end view taken as indicated by line 4—4 on FIG. 2.
Figure 5:
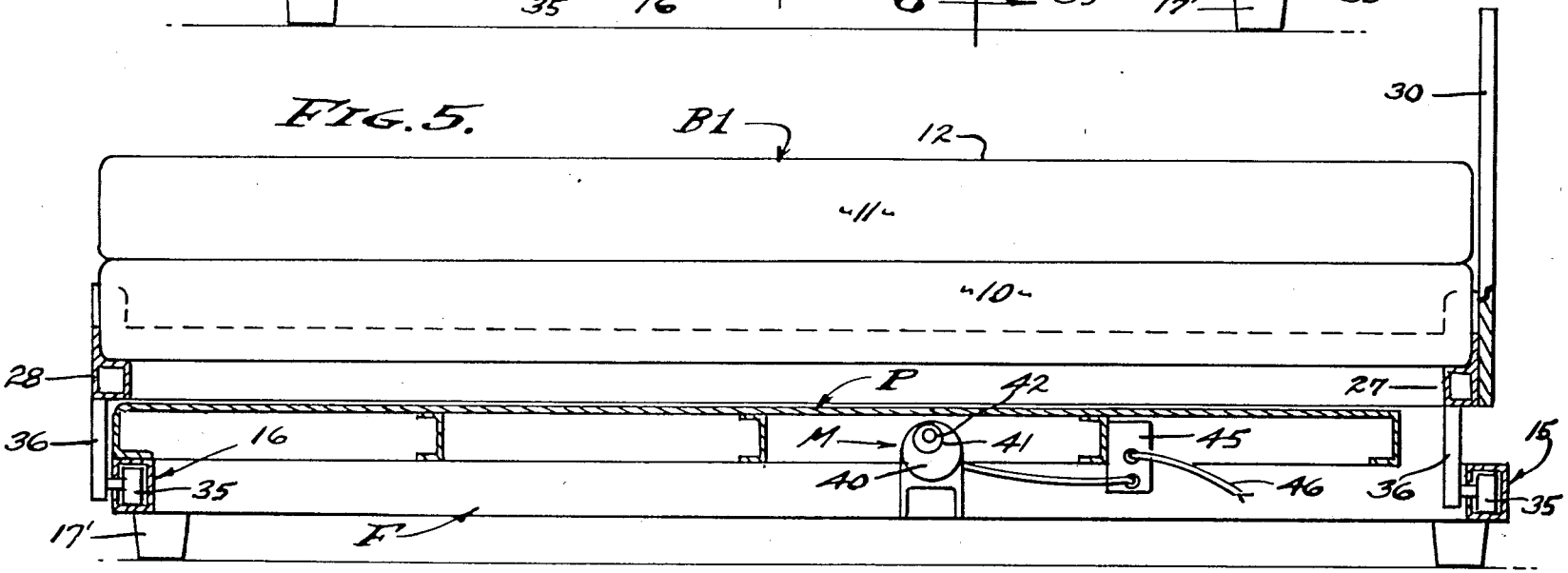
FIG. 5 is an enlarged longitudinal sectional view taken as indicated by line 5—5 on FIG. 2.
Figure 6:
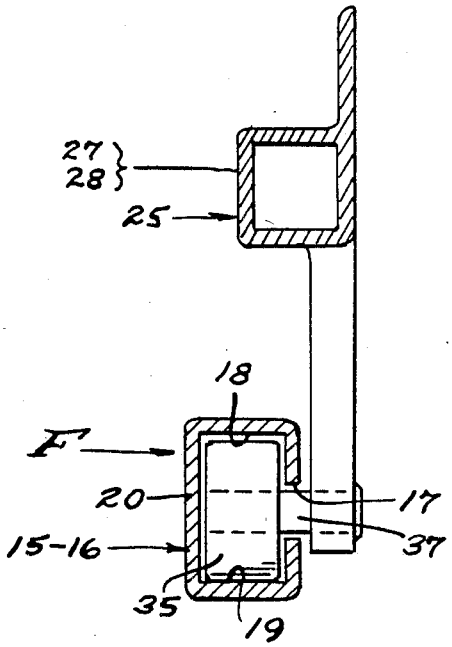
FIG. 6 is an enlarged detailed sectional view of the first form of track-roller support taken as indicated by line 6—6 on FIG. 4.
Figure 10:
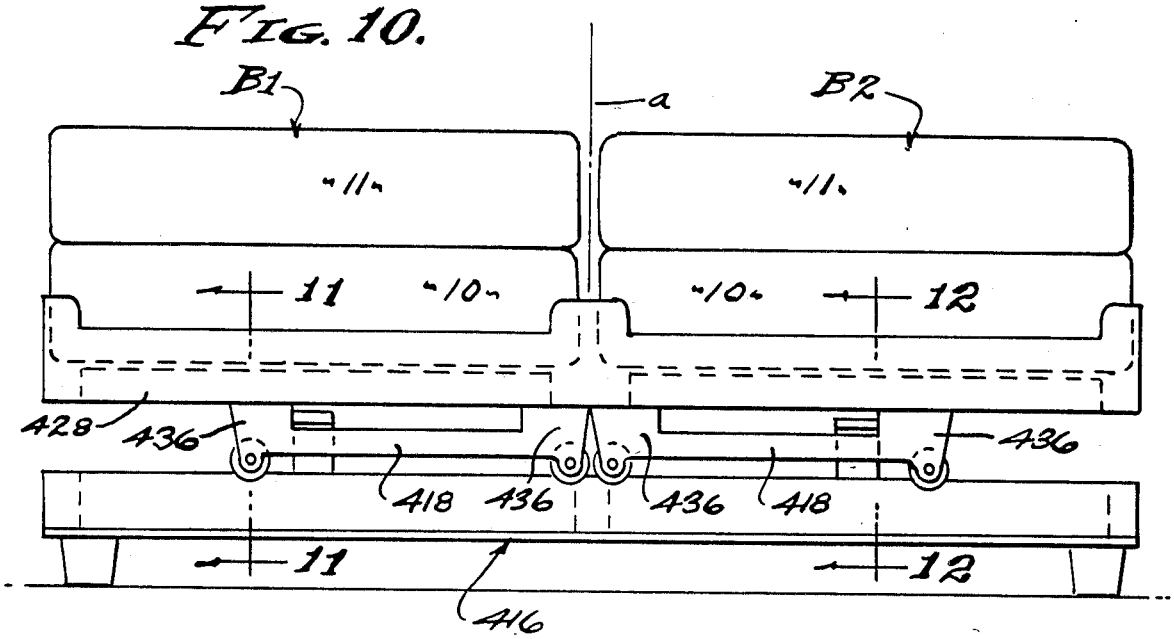

And, FIG. 10 is a view similar to FIG. 3, showing a fifth form of track-roller support.

Figure 11:
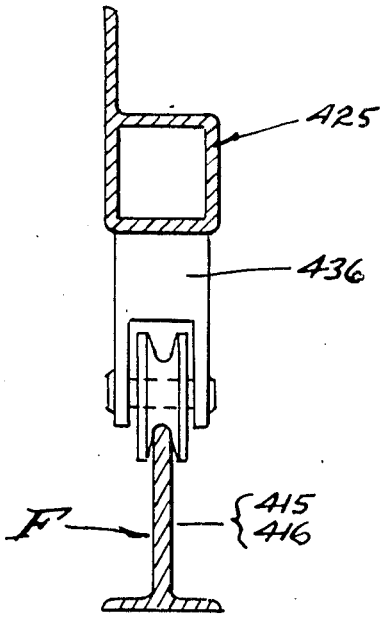
Figure 12:
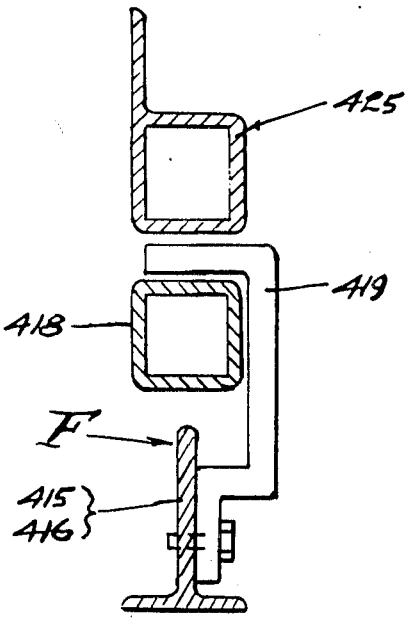

FIGS. 11 and 12 are enlarged detailed sectional views of the track-roller support and taken as indicated by lines 11—11 adn 12—12 on FIG. 10.

PREFERRED EMBODIMENT

Referring now to the drawings, there is the combination of two separable single bed units, one disposed adjacent to the other coextensively along a median line a. The total area of the two single bed units equals or substantially exceeds the area of a usual double spring and mattress unit, and the blanket margins are adapted to be tucked between the springs and mattresses of the two units in the usual manner. As shown, in FIG. 1 of the drawings, the single bed units B1 and B2 are alike and preferably identical, each comprising half of the total double bedding combination, being engageable along the median line a that continues from the headboard to the foot of the mattress combination. Bed sheets and covers are not shown, for clarity in showing the single bed units and their conditioning. As shown, each single bed unit B1 and B2 comprises a rectangular box spring 10 and an overlying mattress 11 of coextensive plan configuration with coplanar sides and ends, and presenting a depressible upper surface 12 upon which occupants are to recline. The construction of the springs and mattresses is conventional, and one or both may be employed as desired, the depth of units B1 and B2 being substantially the same, so that the planar surfaces 12 thereof are coplanar when adjacently brought together.

Figure 1:
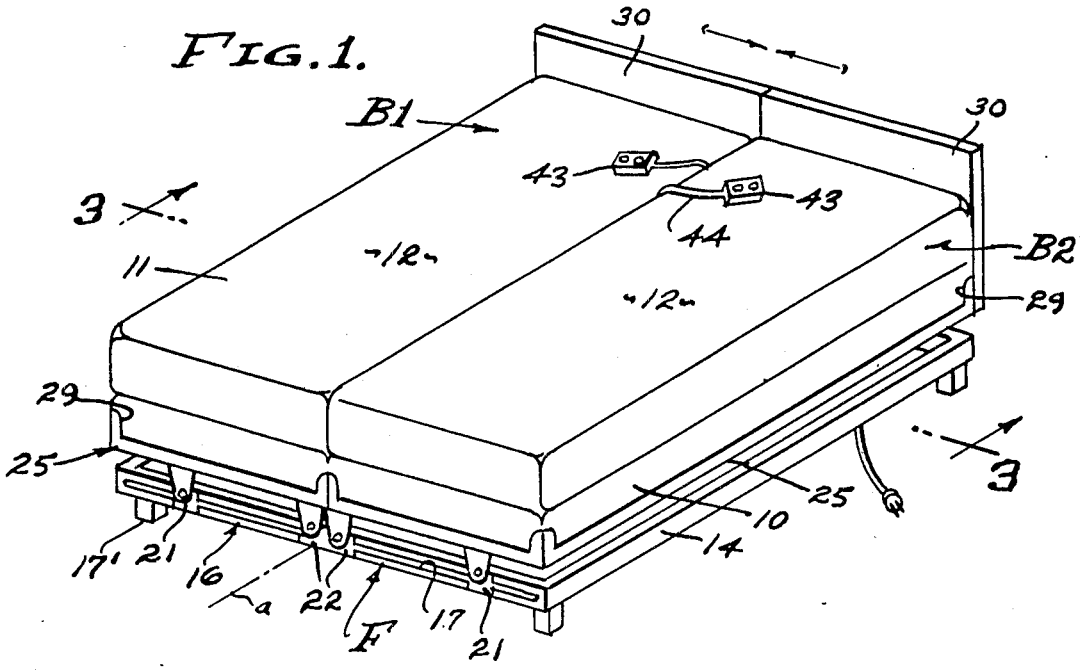
FIG. 1 is a perspective view of the first embodiment Power Operated Separable Beds and Platform shown in the primary double bed condition wherein the two single bed units are juxtaposed adjacently.
Figure 2:
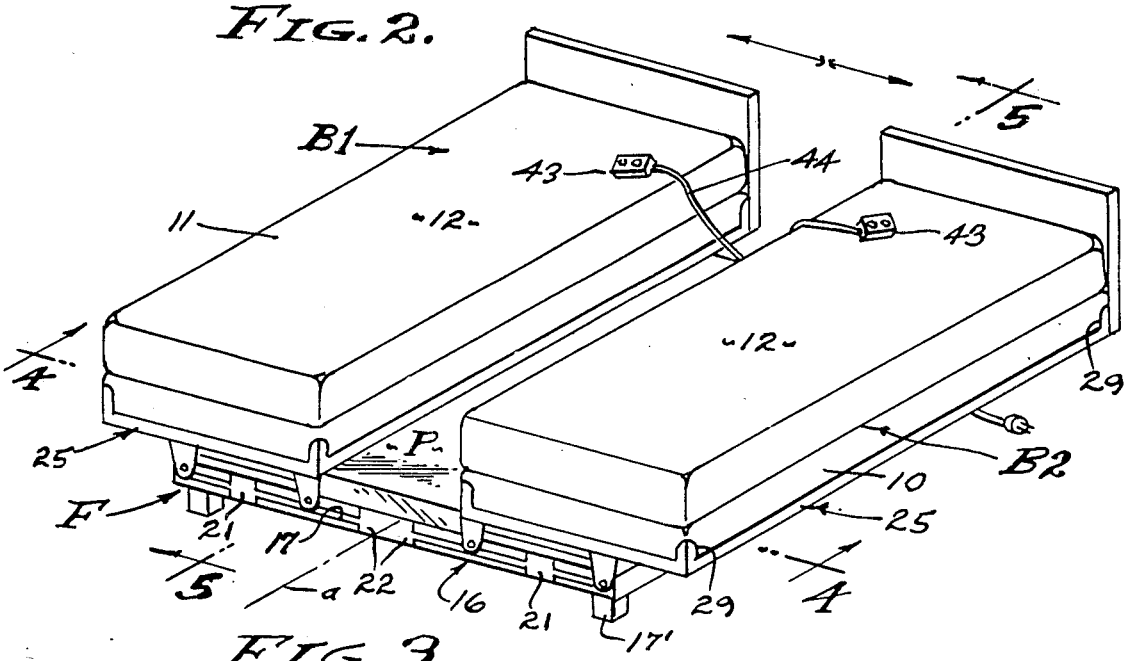
FIG. 2 is a view similar to FIG. 1, showing the secondary single bed condition wherein the two single bed units are separably juxtaposed in parallel relationship.

The platform F is a base structure and is shown in the first embodiment of FIGS. 1 to 6 as a rectangular frame comprised of side rails 13 and 14 joined by a head rail 15 and a foot rail 16. The rails 13 and 14 are stiff elongated members, preferably of rectangular tube cross section, rigidly joined with rails 15 and 16 at right angular corners as by welding or the like. The rails 13–16 are coplanar, in that they are disposed in a common horizontal plane at or above a supporting surface as by legs 171, as shown. A feature of the platform structure F is its C-section track or rails 15 and 16 that guide and restrict the single bed units B1 and B2, and that stabilize the single bed units for cantilevered positioning thereof from the platform F. As shown in FIG. 1, the single bed units B1 and B2 are conditioned to be adjacent at the median line a; however as shown in FIG. 2 they are moved into transversely extended contilevered positions where they are separated and must be stabilized. Accordingly, the C-section rails 15 and 16 are each disposed to present a transverse horizontally disposed side with a slot 17, and with interior upper and lower or bottom walls parallel therewith, for confined rectilinear roller engagement. The slots 17 open at either the front sides or the back sides of the rails, and preferably at the front sides thereof as shown, there being access windows in the front sides of the rails for passage of the rollers into and out of working position; for assembly and disassembly. The head rail and foot rail track-support constructions can be and are shown as being alike, so that a description of one will suffice for both, as follows:

The platform F is a structural base or frame of a width equal to the combined width of two single bed units B1 and B2 later described. In accordance with this invention, the rails 15 and 16 extend transversely the full width of the platform F between the side rails 13 and 14, and in the form of straight side opening C-sections with coextensive slots 17 and parallel top and bottom interior walls 18 and 19. As shown, the C-section rails 15 and 16 are front opening with the slot 17 midway between the top and bottom walls 18 and 19 held spaced and parallel by an integral back wall 20. The slot 17 is dimensioned to freely pass the axle of the roller support later described, and the walls 18 and 19 are spaced to have free antifriction rolling support for the roller later described.

The single bed untis B1 and B2 are like right and left units, so that a description of one will suffice for both, as follows: Each bedding unit B1 and B2 is comprised of a frame 25 that carries box springs 10 and overlying mattress 11. The frame 25 is structural and of a length and width to receive the single bed unit between side rails 26, and head and foot rails 27 and 28. The rails 26–28 are stiff elongated members, preferably of square tubular cross section, rigidly joined at right angular corners as by welding or the like. The rails 26–28 are coplanar, in that they are disposed in a common plane spaced above the plane of the platform F, with the head and foot rails 27 and 28 disposed over their complementary roller suppor rails 15 and 16 of the platform. Each single bed unit B1 and B2 overlies half the area of the underlying platform F, when the inner rail 26 of the frame 25 is coincidental with the median line a and the outer rail 26 disposed over the rail 13–14. The rails 26–28 carry side flanges that are disposed upwardly as shown in order to receive and position the single bed unit, there being angular upstanding corner angles 29 to guide the same. The bed unit head rail 27 and upstanding corner angles 29 carry the head board 30, as furniture disposed against a bedroom wall (not shown).

In accordance with this invention, each of the two single bed units B1 and B2 has two basic conditions with respect to its positions in relation to the underlying support platform F. There is a primary condition of adjacency as shown in FIG. 1, and there is a secondary condition of separation as shown in FIG. 2. Either or both can be so moved as circumstances require. Accordingly, there is anti-friction support means and guide means between the single bed unit (B1 and B2) and the supporting platform F, said means being comprised of the C-section rails 15–16 and supporting guide rollers 35 engaged therewith. The rollers 35 are shown journaled in depending brackets 36 from the frames of the single bed units B1 and B2. As shown, there is a depending bracket 36 and roller 35 at the inner side of the frame 25, and there is a bracket 36 an roller 35 spaced from the outer side of frame 25 a distance substantially equal to the transverse travel desired. A deck or panel P is carried over the platform and beneath the single bed units B1 and B2 and supported by the rails of the platform to occupy the space, between the single bed units. The two brackets 36 depend from the frame rails 27 and 28 to overlie the front opening sides of the roller support rails 15 and 16, the lower end portion of each bracket carrying an axle 37 that is cantilevered to pass freely through the slot 17 and into the C-section of the support rail. Each cantilevered axle is normal to the direction of travel and carries the roller 35 that substantially occupies the interior of the support rail to have rolling engagement with either the top or bottom wall 18 or 19, and by gravity with the bottom wall 19 in the usual manner. There being two bracket 36 and roller 35 supports at both the head and the foot of each bed unit B1 and B2, each of said units is held secure and stable by a captured four wheeled support.

In accordance with this invention, access windows 21 and 22 are provided in the front side of the open C-section support rails 15 and 16, for entry and withdrawal of the rollers 35 into and out of working position. In practice, the windows 21 and 22 are positioned to coincide with the positions of the rollers 35 where they occur at the inner side of the frame 25 and spaced from the outer side of the frame 25, as they are positioned hereinabove, and when the bed units B1 and B2 are in the primary condition of adjacency. Accordingly, all four rollers 35 of each bed unit B1 and B2 register with complementary inner and outer windows 21 and 22 for longitudinal shifting of the bed units with respect to the stationary platform F, for assembly and for disassembly, as may be required. Covers (not shown) may be applied to the upper or lower portions of the windows 21 and 22 to prevent accidental displacement of the rollers 35 from working position within the rails 15 and 16.

In accordance with this invention, there is transport means for positioning the two single bed units in the primary and secondary conditions, as described. the single bed units B1 and B2 are individually motorized to travel between the primary positions of adjacency and the secondary positions of separation. The motorization means can vary in form and is preferably a motor driven screw drive which is directly applied to the rectilinear motion established by the support rails 15 and 16 and roller relationship above described. As shown, each single bed unit is moved by a reversible electric motor M with a drive mechanism 40 that reversably turns a nut or drive tube 41 into which a transport screw 42 is threadedly engaged. The motors M and drive mechanisms 40 are mounted to the platform F at either side of a center beam thereof, and the nut-tube 41 and screw 42 are disposed parallel to the support rails 15 and 16, and with the extended end of the screw 42 anchored to the outer rail 26 of the frame 25 in each instance. Individual or simultaneous control of the motor or motors M is by means of separate dual control panels 43 that are portable and accessible to each occupant at the ends of flexible cords 44 carrying the electrical wiring thereof. There is a control box 45 from which the cords 44 extend and to which power is supplied by a cable 46.

Figure 7:
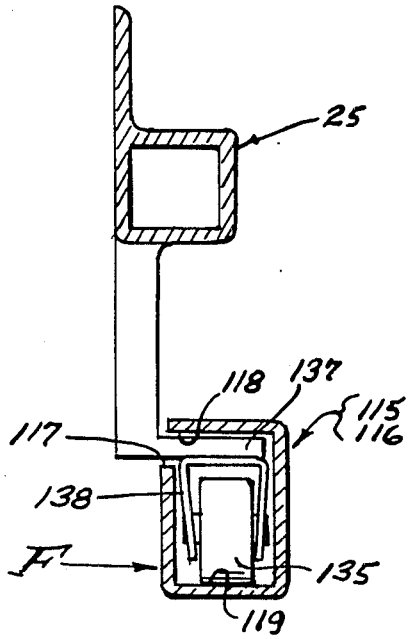
FIG. 7 is a view similar to FIG. 6, showing a second form of track-roller support.

Referring now to FIG. 7 of the drawings and to the second form of this invention, the platform F and bed units (B1 and B2) remain essentially the same as in the first form, with modification to the support means and guide means incorporated therein. The rail configurations of the platform F and bed unit frames 25 is the same except for the location of the slot 117 and the use of a two legged caster type support for the roller 135. As shown, the slot is at the top of the rail 115–116, adjacent to the top wall 118 that faces downwardly to restrict upward movement of a foot 137 that extends freely through the slot. The caster 138 is confied within the C-section of the rail 115–116, the roller 135 bearing upon the bottom wall 119 of the rail 115–116. The access windows are the same as above described, and the transverse extent of rails 115 and 116 are all as above described.

Figure 8:
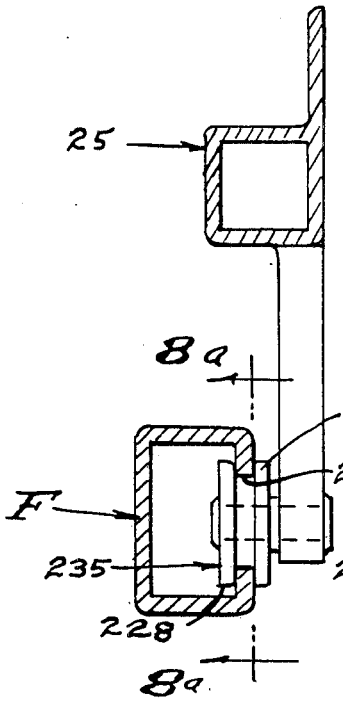
FIG. 8 is a view similar to FIG. 6, showing a third form of track-roller support.
Figure 8A:
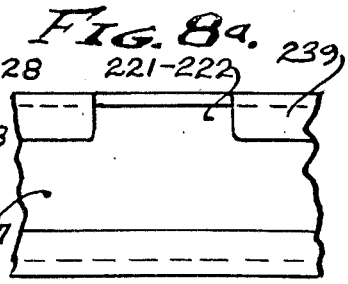

Referring now to FIG. 8 of the drawings and to the third form of this invention, the platform F and bed units (B1 and B2) remain essentially the same as in the first form, with modification to the support means and guide means incorporated therein. The rail configuration of the platform F and bed unit frames 25 is the same except for the size or caliper of the slot 217 and of the tracking configuration of the roller 235. The slot 235 is widened so as to accomodate the roller diameter rather than the axle diameter, the roller 235 having spaced flanges 228 that embrace the upper and lower tracking edges of the slot 217. The windows 221 and 222 are open through the upper and downwardly projecting side 239 that forms said slot, and the windows are cut out to a plane that is coincidental with the inner face of top 218, so that the roller 235 can be lifted for removal.

Figure 9:
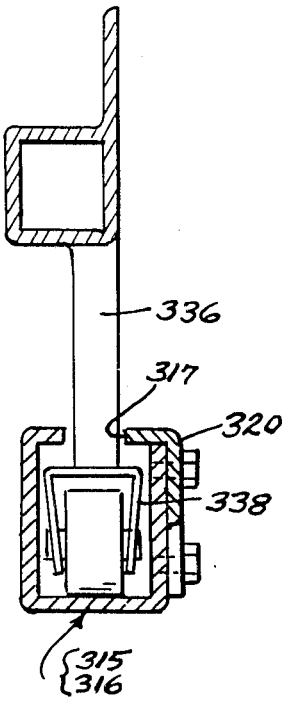
FIG. 9 is a view similar to FIG. 6, showing a fourth form of track-roller support.

Referring now to FIG. 9 of the drawings and to the fourth form of this invention, the platform F and bed units (B1 and B2) remain essentially the same as in the first form, with modification to the support means and guide means incorporated therein. The rail configuration of the platform in this embodiment is upwardly open. That is, the slot 317 opens upwardly for the free passage of the bracket 336, instead of an axle, that carries a caster type roller support 338 confined within the C-section of the rail 315–316. The windows 321 and 322 differ in their location at the top 318 of the support rail 315–316, there being a closure 320 releasably secured by screw fasteners to prevent accidental displacement of the caster type roller support.

Referring now to FIGS. 10 through 12 of the drawings and to the fifth form of this invention, the platform F and bed units B1 and B2 remain essentially the same as in the first form, with modificaiton to the support means and guide means incorporated therein. The rail configuration in this embodiment is open and in the form of an inverted T-section, in which case access windows are not relied upon for access, and an overlying retainer bar 418 cooperates with a retainer-stop 419 to prevent displacement of the bed units B1 and B2 from the platform F. As shown, the retainer bar 418 is part of the bed unit frame 425 and extends horizontally between the spaced support brackets 436 immediately above the rail 418 at both the head and foot. And, the retainer bar 418 has a lip that overlie the bar 418 and also engages with the two brakets 436 to restrict upward movement and to limit the rectilinear travel af the bed unit. The retainer-stop 419 is removeble and releasably secured by screw fasteners to prevent displacement of the bed unit.

From the foregoing it will be seen that a stable bedding unit is provided wherein the platform underlies and supports the selectively moveable single bed units which locate between primary and secondary conditions, converting the bedding unit from a double bed form to a single bed form, all as hereinabove described.

Having described only the typical preferred forms and applicaitons of our invention, we do not wish to be limited or restricted to the specific details herein set forth, but wish to reserve to ourselves any modifications or variations that may appear to those skilled in the art as set forth within the limits of the following claims.

We claim:

1. A composite bedding unit comprised of two like and adjoining single bed units individiually separable from a horizontal platform and each having a head and foot rail and adapted to be juxtaposed to a median line in a primary double bed condition and to be separated from the median line to a secondary single bed condition, and including;

the horizontal platform having transversely disposed head and foot rail supports of slotted C-section configuration and extending parallel one with the other and each transversely slotted substantially coextensively beneath an overlying one of the two single bed units when they are adjacently juxtaposed at the median line in said double bed condition, each of the two single bed units having a head and foot rail extending between inner and outer side rails and complementary to and overlying the head and foot rail supports of the platform and having laterally spaced roller supports carried by the head and foot rails and engageable in the C-section configuration of the head and foot rail supports of the platform to individually carry each of the two single bed units for transverse movement toward and away from each other, the head and foot rails of wach single bed unit having a roller support spaced inward from the outer rail thereof a distance substantially equal to travel of the single bed unit, and having a roller support at the inner rail thereof, said rollers bearing downwardly within the C-section configuration for rolling support, the slotted C-section configurations of the head and foot rail supports of the platform having windows aligned with the roller supports and freely passing the roller support for entry and withdrawal thereof into and from within the C-section configuration of the head and foot rail supports, and transport means for postioning either and both of the two single bed units by transverse movement into either of said primary double bed condition and said secondary single bed condition.

2. The composite bedding unit as set forth in claim 1, wherein the C-section configuration of the head and foot rail supports have top and bottom walls, said roller supports bearing downwardly and upwardly within the C-section configuration for rolling support.

3. The composite bedding unit as set forth in claim 1, wherein the head and foot rail supports extend between opposite side rails of the platform, said head and foot rail supports and opposite side rails being integrally joined at four corners.

4. The composite bedding unit as set forth in claim 1, wherein the head and foot rail supports of slotted C-section configuration are disposed with the slot opened laterally, each of the roller supports being comprised of a bracket depending from the head and foot rails of the single bed units and with a member passing freely through the slot and rotatably carrying a support roller within the C-section configuration.

5. The composite bedding unit as set forth in claim 1, wherein the head and foot rail supports of slotted C-section configuration are disposed with the slot opend laterally, each of the roller supports being comprised of a bracket depending from the head and foot rails of the single bed units and with an axle passing freely through the slot and rotatably carrying a support roller within the C-section configuration.

6. The composite bedding unit as set forth in claim 1, wherein the head and foot rail supports of slotted C-section configuration have top and bottom walls and disposed with the slot opened laterally, the roller supports being comprised of a bracket depending from the head and foot rails of the single bed units and with an axle member passing freely through the slot and rotatably carrying a support roller within the C-section configuration and bearing downwardly and upwardly therein for rolling support.

7. The composite bedding unit as set forth in claim 1, wherein a deck is carried over the platform and supported by the platform rails to occupy the space between the single bed units when in the separated secondary single bed condition.

8. The composite bedding unit as set forth in claim 1, wherein the head and foot rail supports of slotted C-section configuration are disposed toward and away from the foot rails for assembly and disassembly by the roller supports passing through said windows.

9. The composite bedding unit as set forth in claim 1, wherein the head and foot rail supports of slotted C-section configuration are disposed with the slot opened laterally adjacent a top wall thereof, each of the roller supports being comprised of a bracket depending from the head and foot rails of the single bed units and with a member passing freely through the slot and rotatably carrying a support roller within the C-section configuration and bearing on a bottom wall thereof.

10. The composite bedding unit as set forth in claim 1, wherein the head and foot rail supports of slotted C-section configuration are disposed with the slot opened laterally adjacent a top wall thereof, each of the roller supports being comprised of a bracket depending from the head and foot rails of the single bed units and with a member passing freely through the slot and carrying a caster with a pair of legs rotatably carrying a support roller within the C-section configuration and bearing on a bottom wall thereof.

11. The composite bedding unit as set forth in claim 1, wherein the head and foot rail supports of slotted C-section configuration are disposed with the slot opened laterally and having upper and lower track edges, each of the roller supports being comprised of a bracket depending from the head and foot rails of the single bed units and with a flanged support roller having a groove engaged simultanesouly with said upper and lower track edges for rolling confinement therebetween.

12. The composite bedding unit as set forth in claim 1, wherein the head and foot rail supports of slotted C-section configuration are disposed with the slot opened upwardly at a top wall thereof, each of the roller support being comprised of a bracket depending from the head and foot rails of the single bed units and passing freely through the slot and rotatably carrying a support roller within the C-section configuration and bearing on a bottom wall thereof.

13. A composite bedding unit comprised of two like and adjoining single bed units individually separable from a horizontal platform and each having a head and foot rail and adapted to be jaxtaposed to a median line in a primary double bed condition and to be separated from the median line to a secondary single bed condition, and including;

the horizontal platform having transversely disposed head and foot rail supports of inverted T-section configuration and extending parallel one with the other and each with a track extending substantially coextensively beneath the widths of the two single bed units when they are adjacently juxtaposed at the median line in said double bed condition, each of the two single bed units having a head and foot rail extending between inner and outer side rails and complementary to and overlying the head and foot rail supports of the platform and having laterally spaced roller supports carried by the head and foot rails and with a roller engageable upon the track of the T-section configuration of the head and foot rail supports of the platform to individually carry each of the two single bed units for transverse movement toward and away from each other, the head and foot rails of each single bed unit having a first roller support spaced inward from the outer rail thereof a distance substantially equal to travel of the single bed unit, and having a second roller support at the inner rail thereof, a horizontally diposed retainer bar extending between the first and second roller supports and a retainer stop removably fixed to the platform and with a lip overlying the retainer bar and alternately engageable with the first and second roller supports to position the single bed units in said primary and secondary conditions, and transport means for positioning either and both of the two single bed units by transverse movement into either of said primary double bed condition and said secondary single bed condition.

14. The composite bedding unit as set forth in claim 13, wherein a deck is carried over the platform and supported by the platform rails to occupy the space between the single bed units when in the separated secondary single bed condition.

* * * * *